United States Patent [19]

Hurtes

[11] 3,971,685

[45] July 27, 1976

[54] APPARATUS AND PROCEDURE FOR MANUFACTURING ARTICLES HAVING A NON-WOVEN PILE

[76] Inventor: Walter Hurtes, 433 W. 34th St., New York, N.Y. 10001

[22] Filed: July 31, 1975

[21] Appl. No.: 600,601

Related U.S. Application Data

[63] Continuation of Ser. No. 436,640, Jan. 25, 1974, abandoned, which is a continuation-in-part of Ser. No. 229,065, Feb. 24, 1972, abandoned.

[52] U.S. Cl. ..... 156/72; 26/51; 28/72 NW; 156/435; 156/496

[51] Int. Cl.[2] ..... D04H 11/08; D06C 3/00

[58] Field of Search ..... 156/62.2, 62.4, 72, 156/167, 176, 248, 265, 297, 435, 436, 439, 440, 441, 464, 466, 494–496, 519; 26/51, 54; 28/1 CS, 2, 5, 55.5, 72 P, 72 NW, 72.3

[56] References Cited

UNITED STATES PATENTS

| | | | |
|---|---|---|---|
| 2,792,051 | 5/1957 | Jaquet | 156/176 |
| 2,958,909 | 11/1960 | Bradley et al. | 156/176 |
| 3,016,945 | 1/1962 | Wexler | 156/441 |
| 3,477,889 | 11/1969 | Partensky | 156/435 |
| 3,479,241 | 11/1969 | Partensky | 156/72 |
| 3,499,807 | 3/1970 | Hurtes | 156/72 |
| 3,531,347 | 9/1970 | Stultz | 156/494 |
| 3,697,344 | 10/1972 | Temple | 156/72 |
| 3,732,135 | 5/1973 | Ernst et al. | 156/297 |
| 3,831,232 | 8/1974 | Bondi | 156/72 |

FOREIGN PATENTS OR APPLICATIONS

| | | | |
|---|---|---|---|
| 790,498 | 2/1958 | United Kingdom | 156/72 |

*Primary Examiner*—William A. Powell
*Assistant Examiner*—John E. Kittle
*Attorney, Agent, or Firm*—Cooper, Dunham, Clark, Griffin & Moran

[57] ABSTRACT

In apparatus for making a pile article by applying a backing to free ends of an assembly of pile fibers, the combination of means for forming pile units each comprising a laterally compressed and substantially radially symmetrical array of pile fibers, means for supporting assembled pile fibers, means for distributing a plurality of the pile units transversely across the supporting means and releasing the fibers thereof from lateral compression, and means for advancing the released pile units longitudinally of the supporting means while applying a force for promoting lateral expansion of the released units into a continuous assembly of fibers, prior to application of the backing. Procedure wherein an assembly of pile fibers is advanced in a given direction for application of a backing, including the steps of distributing a plurality of the aforementioned pile units in a direction transverse to the given direction, releasing them from lateral compression, and advancing them in the given direction while applying a force for promoting expansion of the released pile units.

23 Claims, 23 Drawing Figures

DISC SELECTION, FEED & TRANSPORT MECHANISM

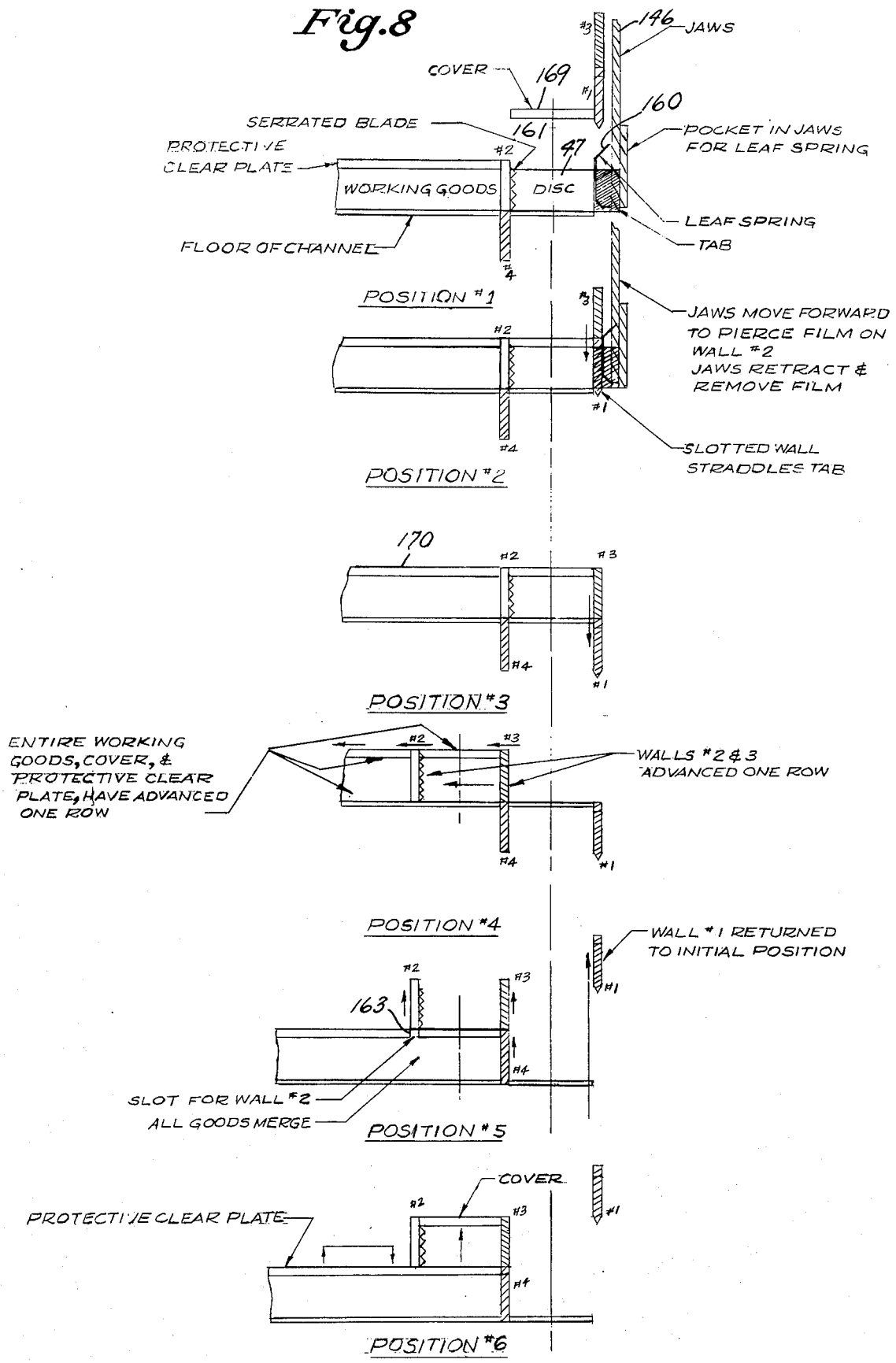
Fig.8
146
JAWS
#3
COVER
169
#1
160
SERRATED BLADE
161
POCKET IN JAWS FOR LEAF SPRING
PROTECTIVE CLEAR PLATE
#2
47
WORKING GOODS
DISC
LEAF SPRING
TAB
FLOOR OF CHANNEL
#4
POSITION #1
JAWS MOVE FORWARD TO PIERCE FILM ON WALL #2
JAWS RETRACT & REMOVE FILM
SLOTTED WALL STRADDLES TAB
POSITION #2
170
POSITION #3
ENTIRE WORKING GOODS, COVER, & PROTECTIVE CLEAR PLATE, HAVE ADVANCED ONE ROW
WALLS #2 & 3 ADVANCED ONE ROW
POSITION #4
WALL #1 RETURNED TO INITIAL POSITION
163
SLOT FOR WALL #2
ALL GOODS MERGE
POSITION #5
COVER
PROTECTIVE CLEAR PLATE
POSITION #6

Fig. 9
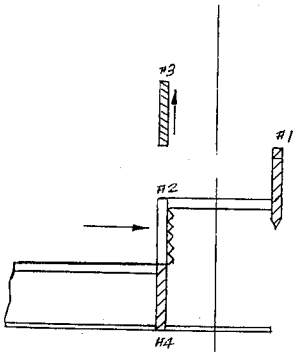
POSITION #7
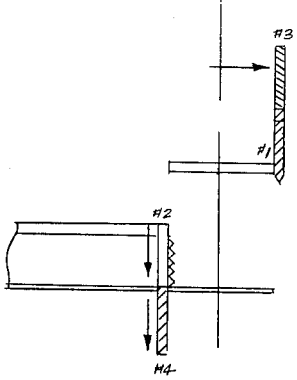
READY FOR REPEAT CYCLE
POSITION #8
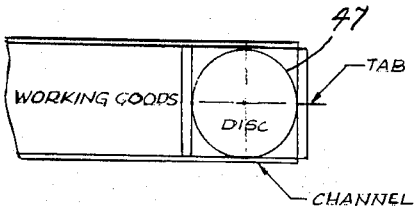
TOP VIEW
Fig. 10

STACK INFEED & UNLOADING
(MOVEABLE TRIP POINT)

APPARATUS AND PROCEDURE FOR MANUFACTURING ARTICLES HAVING A NON-WOVEN PILE

This is a continuation of application Ser. No. 436,640 filed Jan. 25, 1974, which in turn was a continuation-in-part of Ser. No. 229,065 filed Feb. 24, 1972, both now abandoned.

BACKGROUND OF THE INVENTION

This invention relates to the manufacture of nonwoven pile articles, especially of the type wherein a backing is bonded to free ends of an assembly of pile yarns or fibers. In a particular sense, the invention is directed to apparatus and procedures for producing such articles on a substantial scale in an effectively continuous, automated manner.

Seamless pile articles of large size, e.g. carpets, are produced commercially as elongated webs that may have a width ranging up to twelve or even fifteen feet or more. Desirably, such pile materials should be made more or less continuously by automated apparatus having high production speeds, with economy in consumption of pile fibers, capability of forming varied and intricate patterns, and selectively in control of pile density.

In present-day commercial techniques for making pile articles of extended size, the individual pile-forming yarns or fibers (herein termed pile elements) are commonly bent into loops which are passed through or otherwise secured to a backing. The looped portions of the pile elements, which represent a substantial proportion of the total pile fiber used, do not contribute to the appearance or density of the pile because they are attached to the backing. Consequently, the described looping techniques involve uneconomical consumption of pile fiber. Owing in particular to the necessity of forming thousands of individual pile element loops, commercially available machines for producing pile articles by looping techniques tend to have slow production speeds and to be subject to frequent breakdowns or other interruptions of operation.

It has also heretofore been proposed to make a pile article by forming an assembly of "straight" (i.e. non-looped), substantially aligned pile fibers, and bonding a backing to the free ends of the assembled fibers. The elimination of loops in these so-called bonding techniques represents a substantial saving in pile fiber, as compared with looping techniques, for production of a pile of given depth and density; in addition, the mechanical problems of loop forming are avoided.

Serious disadvantages have nevertheless attended efforts to adapt bonding techniques to large-scale commercial production, especially in respect to the provision of means and methods for forming, handling and maintaining the assembly of aligned fibers prior to application of the backing. In particular, it has heretofore been supposed that the assembly of fibers must be continuously positively maintained in a compacted condition, as by lateral compression, until the backing is applied, for prevention of misalignment of the fibers. This requirement has precluded attainment of desired flexibility or selectively in control of pile density, and has necessitated use of inconveniently complex mechanical expedients for handling the fiber assembly. Such procedure effectively precludes use of twisted yarn (which is already very dense and compact) as pile elements, because the requisite compaction of the pile elements would, in the case of twisted yarn, produce a pile of unacceptably high density wherein the individual elements could not be caused to bloom as in conventional twisted-yarn piles.

Other problems have been encountered in attempting to provide for cutting and feeding pile fibers to the assembly. For example, in one known type of bonding apparatus, a continuous strip of long, aligned fibers (equal in width to the pile article to be made) is progressively fed to a pile-forming locality where it is sheared to provide successive thin rows of cut pile fibers, these rows being individually advanced into compacted assembly with previously cut rows of fibers for subsequent application of a backing thereto. Apart from the difficulty of achieving uniform longitudinal feed of elongated aligned fibers, the strip feeding arrangement prevents pattern variations along the length of the produced pile article, i.e. unless the feed of fibers is repeatedly interrupted for change in color of fibers being fed. Since the strip of fibers must be very thin in order to be effectively uniformly sheared, each incremental addition to the pile fiber assembly (i.e. the thickness of each successively advanced row of cut fibers) is correspondingly small, resulting in slow production speeds. Moreover, it is difficult to handle a very long continuous row of cut fibers, as required for production of a wide pile article owing to the fact that each row of cut fibers extends over the full width of the produced article.

Alternatively it has been proposed to prepare relatively small groups of aligned cut fibers which are adhered together in some removable manner, as by freezing in water; and, after a plurality of these groups or blocks of adhered fibers are assembled together and secured to a backing, to remove the initial fiber-adhering substance. This technique involves problems, e.g. in supplying and removing an adhering fluid, as well as increased cost, and again, does not permit desired control of pile density because the fibers remain adherent to each other until after they are bonded to the backing.

Applicant's prior U.S. Pat. No. 3,499,807, discloses a method of making non-woven pile articles by forming a plurality of pile units each comprising an array of substantially aligned pile yarns or fibers laterally compressed within a surrounding removable sleeve. The pile units, which may be radially symmetrical, are positioned (e.g. by hand) on an assembly surface in a desired arrangement to constitute a complete pile assembly. Thereafter, the sleeves are removed, and a backing is applied to the free ends of the assembled fibers. This method, while capable of forming satisfactory pile articles on a piecework basis, requires substantial manual labor and thus, insofar as described in the aforementioned patent, does not constitute a commercially competitive procedure for large-scale mass production of pile articles such as extended carpeting and the like.

SUMMARY OF THE INVENTION

An object of the present invention is to provide new and improved apparatus and procedures for making non-woven pile articles by bonding a backing to free ends of assembled fibers, characterized by advantageously superior control of pile density.

Another object is to provide such apparatus and procedures for large-scale commercial production of pile articles such as carpeting and the like at desirably rapid production speeds and with advantageous improvements in forming and handling an assembly of pile fibers.

A further object is to provide such apparatus and procedures capable of producing pile articles having diverse and intricate patterns.

Still another object is to provide apparatus and procedures for performing pile-forming operations with pile units as generally disclosed in applicant's aforementioned patent but in an automated and continuous manner.

To these and other ends, the present invention broadly contemplates the provision of apparatus including means for forming pile units each comprising a substantially radially symmetrical array of fibers oriented such that ends of the fibers are at the ends of the units, and laterally compressed together but separable in maintained orientation upon release from lateral compression; means for supporting plural pile units in side-by-side relation; means for successively disposing a plurality of groups of the pile units from the forming means side-by-side on the supporting means while maintaining the fibers of each unit laterally compressed together, each group comprising plural units distributed transversely of the supporting means, the disposing means including means for releasing the fibers of each pile unit from lateral compression upon disposition thereof on the supporting means; means for laterally advancing the released pile units longitudinally of the supporting means while permitting expansion thereof and while applying a force to the released units for promoting expansion thereof by separation of the fibers thereof in maintained orientation, to produce a continuous assembly of pile fibers; and means for applying an adherent backing to at least one end of the fibers of the assembly to form a pile article.

Applicant has found, surprisingly in relation to prior bonding techniques, that when the fibers of a pile unit as described above are released from lateral compression even while being laterally advanced, the unit "blooms" or expands without disorientation of the constituent fibers. Thus, by first releasing the fibers of the unit and then advancing them while permitting such expansion and while applying a force to promote such expansion, the units rapidly merge into a continuous pile fiber assembly of desirably uniform density. Moreover, this density may be advantageously controlled, over a substantial range, for attainment of a selected density in the ultimately produced pile.

The disposition of the pile units in successive groups each comprising plural units distributed transversely of the supporting means (i.e. across the width of the article being produced) facilitates desired pattern variation. Thus, pile units in the same relative position in each of successive groups may be of respectively different colors or arrays of color (since fibers of plural colors may be incorporated in a single pile unit), providing pattern variations along the length as well as across the width of the produced article. For instance, border area rugs may be produced in this way on large-scale automated equipment.

As an important specific feature of the present invention, i.e. in combination with the features discussed above, the pile-unit-forming means may comprise means for forming an elongated and substantially radially symmetrical (e.g. cylindrical) bundle of fibers extending longitudinally of the bundle, and for laterally compressing the bundle while wrapping and securing a removable sheath around the bundle to hold the fibers thereof laterally compressed; and means for slicing the bundle transversely into plural pile units each having a surrounding removable sheath portion laterally compressing the fibers thereof. In this combination, the provision of a sheathed bundle facilitates handling of the elongated fibers prior to cutting of the pile units, while the slicing means enables provision of pile units of substantial transverse dimension (diameter). Since each incremental addition to the assembly of fibers, in the apparatus of the invention, corresponds to a group of pile units and has a magnitude determined by the diameter of the units in the group, use of pile units of substantial diameter enhances production speed. As will be understood, the term "slicing" as herein used refers to cutting with a thin, knifelike blade which not only progressively advances into the material being cut but also moves, in reciprocating or rotary manne, transversely thereof during the cutting operation.

As will now be apparent, the invention enables practicable attainment of the fiber savings characteristic of bonding techniques, in commercial-scale production of large pile articles, in a way that overcomes disadvantages of prior types of bonding operations.

The invention also embraces procedure for making pile articles, including the steps of forming pile units, distributing successive groups of the units, releasing the fibers of the distributed units from lateral compression, advancing the released units while applying a force thereto to promote expansion thereof, and applying a backing to the resultant assembly of fibers, all as more particularly described above with reference to the apparatus of the invention.

Further features and advantages of the invention will be apparent from the detailed description hereinbelow set forth, together with the accompanying drawings.

BRIEF DESCRIPTION OF THE DRAWINGS

In the drawings, to which reference will be made in the specification, similar reference characters have been employed to designate corresponding parts throughout the several views.

FIG. 8 is a schematic side elevational view showing altered relative positions of certain movable walls forming means for advancing oriented fibers during operation of the embodiment.

FIG. 9 is a similar schematic side elevational view showing subsequent positioning steps.

FIG. 10 is a fragmentary top plan view corresponding to the uppermost position of FIG. 8.

DETAILED DESCRIPTION

In the following description, reference will be made to pile units of the type generally disclosed in applicant's aforementioned U.S. Pat. No. 3,499,807. The method of that patent includes the steps of forming a plurality of basic pile units, each having a plurality of elongated fibers, the axes of which are aligned to mutually parallel relation, the fibers being surrounded by a sleeve which maintains a plurality of said fibers in relatively compressed condition. These individual units are then placed upon a surface, and within an enclosure preventing expansion of the fibers beyond a desired area when the sleeves are subsequently removed. The ends of the fibers are secured to a desired adhesive-coated surface, usually a textile web.

It will be apparent that the method of the prior patent requires considerable hand labor, as well as a degree of skill, both in the formation of the individual units, which is accomplished by radially compressing axially oriented fibers in a cylinder, which cylinder is subsequently severed into short lengths transversely of the principal axis thereof; and the subsequent placing of the individual units on the surface, following which the sleeves are removed.

It will be appaarent to those skilled in the art that while the preferred embodiment of this invention suggests that the pile units be cut squarely, other effects can be obtained if the cutting is made in a non-square plane.

Figure 1:
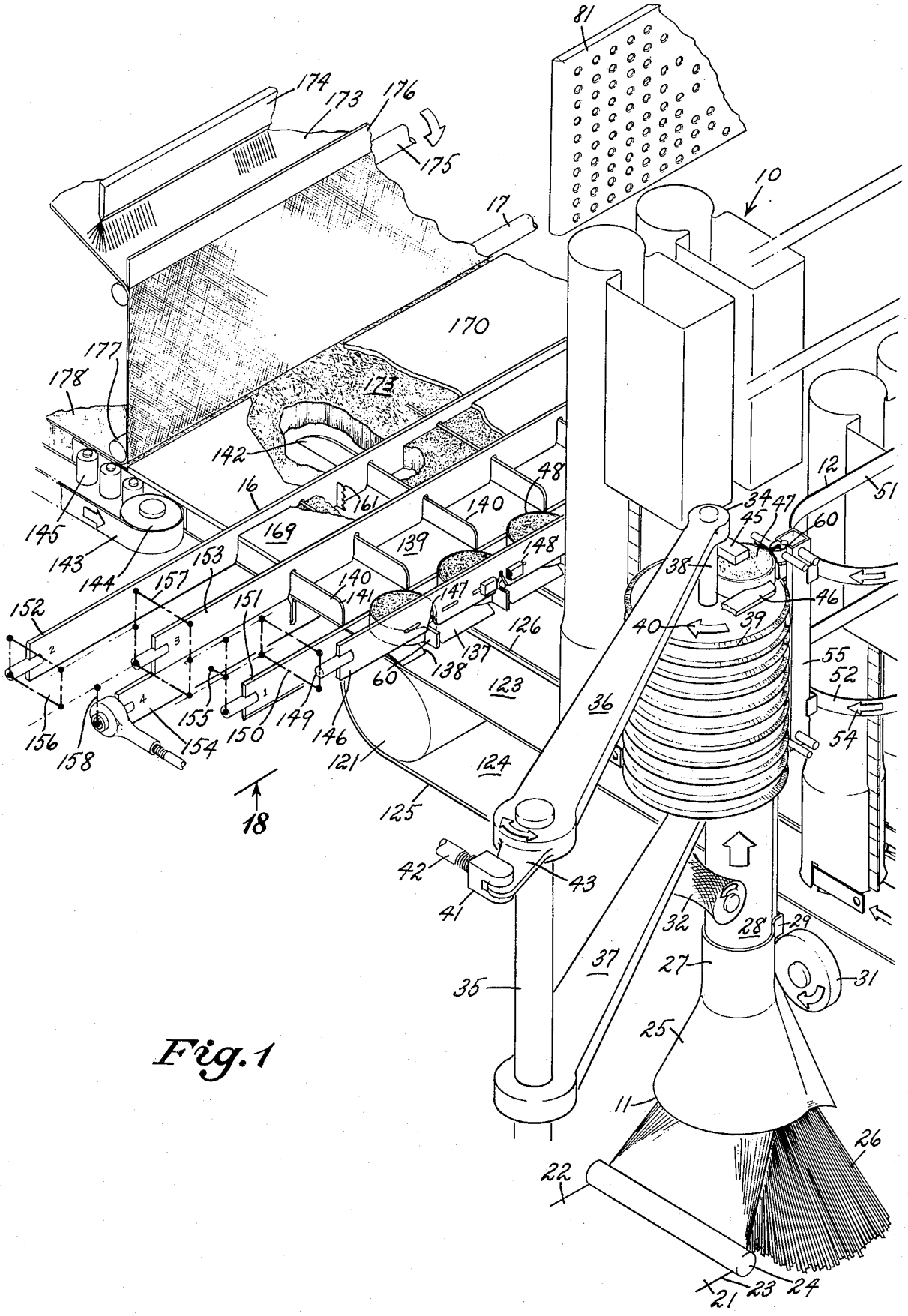
FIG. 1 is a fragmentary view in perspective of a part of an embodiment of the invention.
Figure 2:
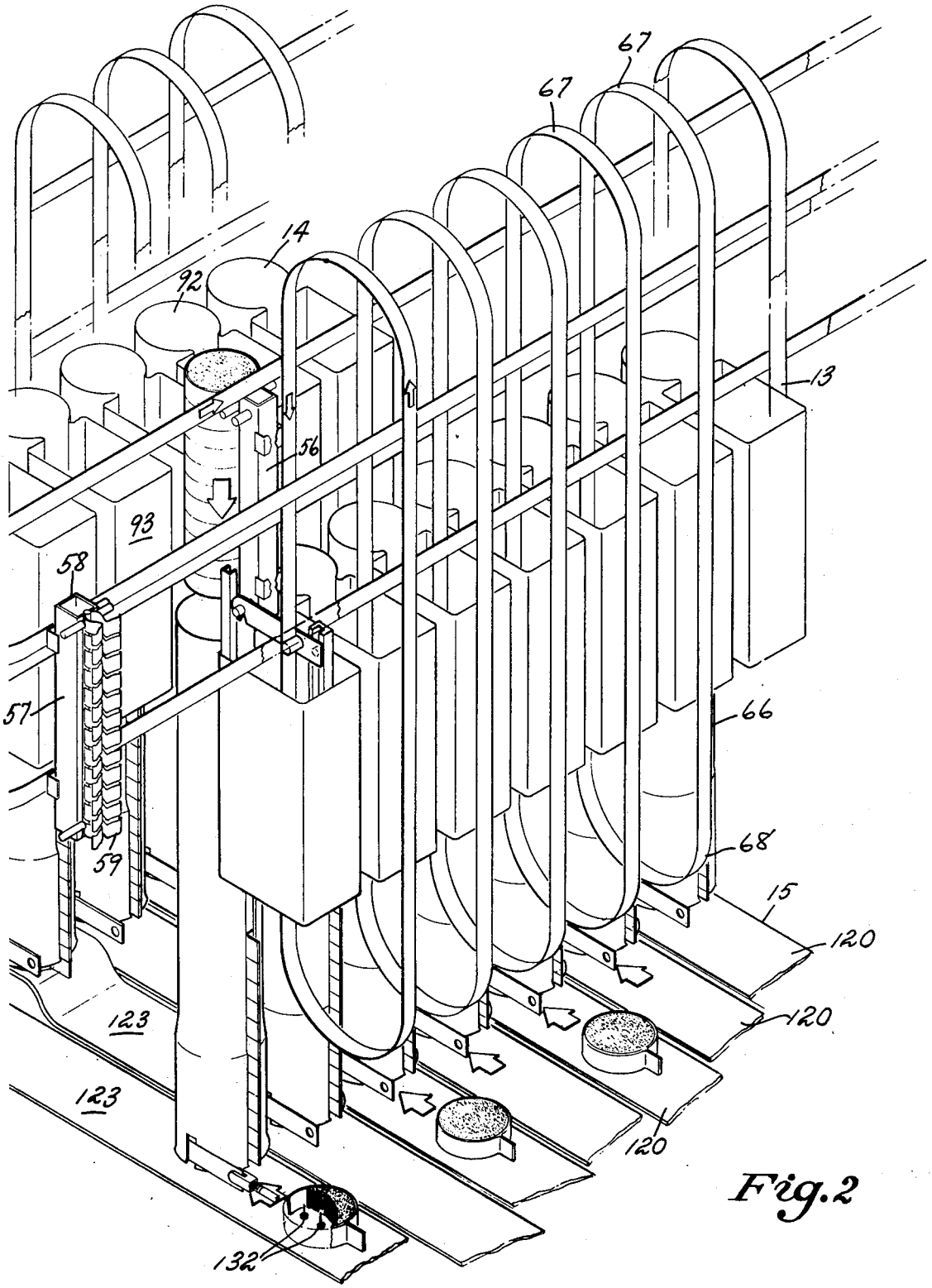
FIG. 2 is a similar fragmentary view in perspective of the embodiment to be read in conjunction with FIG. 1.

In accordance with the present invention, the apparatus generally indicated by reference character 10, and best understood from a consideration of FIGS. 1 and 2, comprises broadly: pile unit forming means 11, primary pile unit horizontal transfer means 12, secondary pile unit vertical transfer means 13, pile unit stacking and discharge means 14, pile unit longitudinal transfer means 15, pile assembly means 16, and web laminating means 17.

The pile unit forming means 11 serves to enclose a continuous flow of oriented fiber of either short staple or long staple form. The fiber may be natural, synthetic, or mixtures of both, depending upon the desired effect in the finished article. A continuous web 21 of polyethylene sheeting or similar heat sealable material unfurls from a source (not shown) and extends between side edges 22 and 23. After passing a roller 24, the web enters a funnel-shaped guide 25 which also receives the above mentioned fiber 26, which may be in the form of yarn, tow, or roving. The guide 25 merges with a cylindrical sleeve 27 having two radially extending flanges, one of which is indicated by reference character 29, defining a slot accommodating a pair of heat-sealing rollers, one of which is indicated by reference character 31. A plurality of horizontal axis rollers, one of which is indicated by reference characters 32, are knurled to provide adequate tension on the cylindrical sleeve 28 as the same is moved upwardly in incremental fashion as the cylinder 28 is formed.

A multiple cutting unit at 34 simultaneously cuts the cylinder 28 to form a plurality of basic pile units at periodic intervals. It is mounted on a vertical shaft 35 by an upper arm 36 and a lower arm 37 which are interconnected by an orbitally moving shaft 38 mounting a plurality of circular cutting blades 39. These are driven in the direction indicated by the arrow 40 by means not shown, preferably in the form of a small electric motor. A clevis member 41 interconnects a rod 42 with an extension 43 on the upper arm 36 which moves the unit 34 into engagement with the cylinder 28 during the cutting operation. As will more fully appear, this cutting operation takes place while the cylinder is supported by the stacking means 14. An upper stop 45 and side guides, one of which is indicated by reference character 46, position the formed unit 47 as the cutting takes place.

The horizontal transfer means 12 serves to move a freshly cut stack of units 47 transversely on demand to selected units of the means 14, and includes an upper belt 51 and a lower belt 52 positioned as shown in FIG. 2 by means (not shown). The belts move in the direction of the arrow 54, that is to say, clockwise as seen in FIG. 2, and support a plurality of pile unit carrier elements 55, 56 and 57. These elements are substantially similar, each including a rectangular tubular body 58 supporting a plurality of clamps 59 which engage the tabs 60 of the units 47 which are formed by the heat-sealing rollers 31, and which radially project from the periphery thereof. The clamps 59 are opened by pins 61 (see FIG. 16) much in the manner of a spring clothespin, and are moved to opened position to permit a length of the cylinder 28 to move upwardly by actuating means described hereinafter. The clamps 59 are closed just prior to the cutting operation, so that when the cutting is complete, each individual unit 47 will be supported by a clamp in a manner best seen in FIG. 16 in the drawing. Thus, when the blades 39 have completed the cutting operation, and are moved out of the way, the elements 55–57 may be moved along the means 12 without interference. The elements 55–57 are secured to the belts 51–52 by resilient means 63 illustrated in FIG. 17, and are provided with attaching means 64 in the form of projecting pins to enable the same to be engaged by the secondary vertical transfer means 13.

Figures 15, 16, 17:
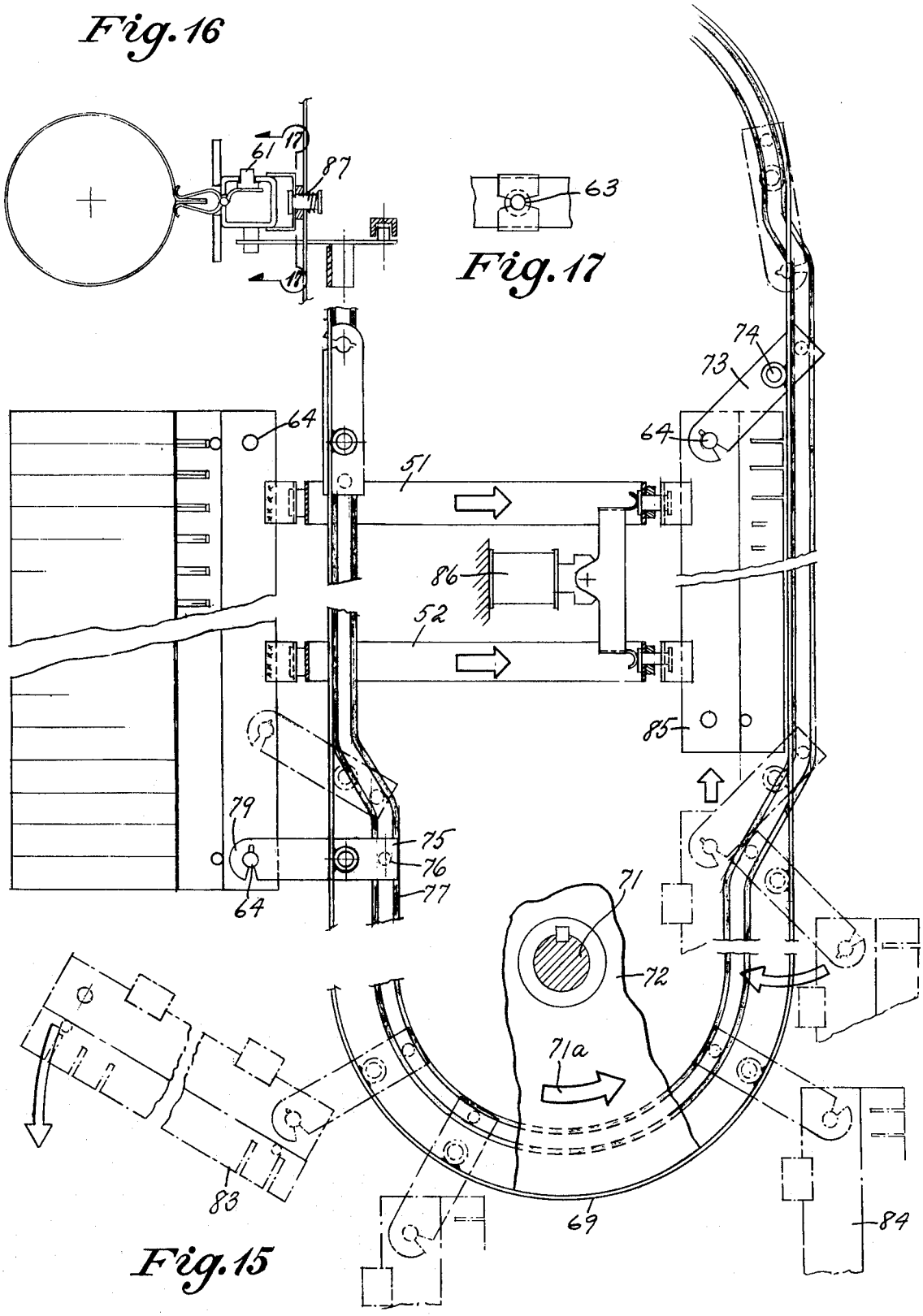
FIG. 15 is a fragmentary side elevational view, partly in section, showing the mechanism for transferring a stack of pile units from a horizontal transporting means to the structure shown in FIG. 11.
FIG. 16 is a fragmentary top plan view as seen from the upper portion of FIG. 15.
FIG. 17 is a fragmentary view in elevation showing the means for engaging a pile unit stack carrier with a stack carrier horizontal transport means.

Means 13 shown in FIG. 2 includes a plurality of vertically disposed belts 66, each having a continuous upper loop 67 and a continuous lower loop 68. They are moved by a supporting and guiding means 69 (FIGS. 15 – 17, inclusive). A common drive shaft 71 keeps all of the belts 66 in motion in the direction of the arrow 71A, motion being transmitted through a pulley 72. A plurality of pivotally mounted links 73 are mounted on each of the belts 66, each link including a main pivot axis pintle 74, and an inner end 75 supporting a cam follower pin 76 entrained within a camming channel 77.

Referring to FIG. 15, a lower pin 64 on each of the elements 55–57 is engaged by the free end 79 of a link 73 which is cammed to horizontal position at the moment of engagement. Continued downward movement disconnects the attaching means 63, and the tendency of the element 55–57 to tilt counterclockwise as seen in FIG. 15 is prevented by airblast means 81 (FIG. 1) which stabilizes the element 55–57 until it enters a unit of means 14. An upper pin 61 is engaged by means 14 to release the units 47 at a proper moment, and subsequently, the empty elements 55–57 move through a path indicated by dash lines at 83, 84 and 85. At a point of reengagement with the primary transfer means, an air cylinder 86 resiliently urges the pin structure shown in FIGS. 16 and 17 to open position to permit reengagement of the element 55–57 to the means 12, whereby it may be returned to its initial position to pick up a subsequent plurality of units 47. When released, the pins 87 (FIGS. 16–17) return to relatively unstressed condition engaging the elements 55–57 as shown in FIG. 16. During operation of the device 10, the above-described sequence occurs continuously, the speed of the device being such that the rate of transfer of a stack of units 47 on demand is less than the rate at which new pile units are formed, and by suitable programming, an element 55–57 moves to the needed area before the remaining units have been depleted. As the element 55–57 descends for unloading, the clamps 59 are opened by means of a lever 89 actuated by structure shown in FIG. 12 described hereinbelow.

Figure 12:
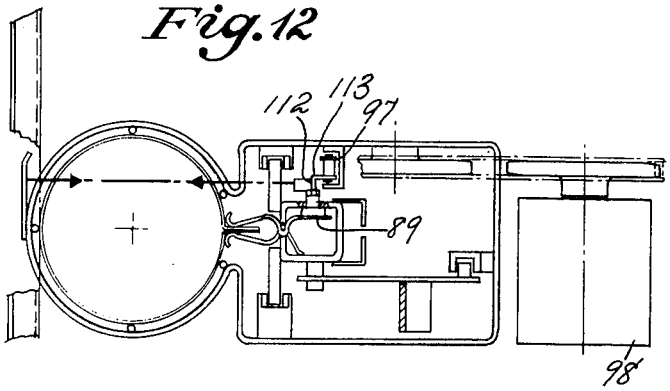
FIG. 12 is a fragmentary top plan view as seen from the plane 12—12 in FIG. 11.
Figure 11:
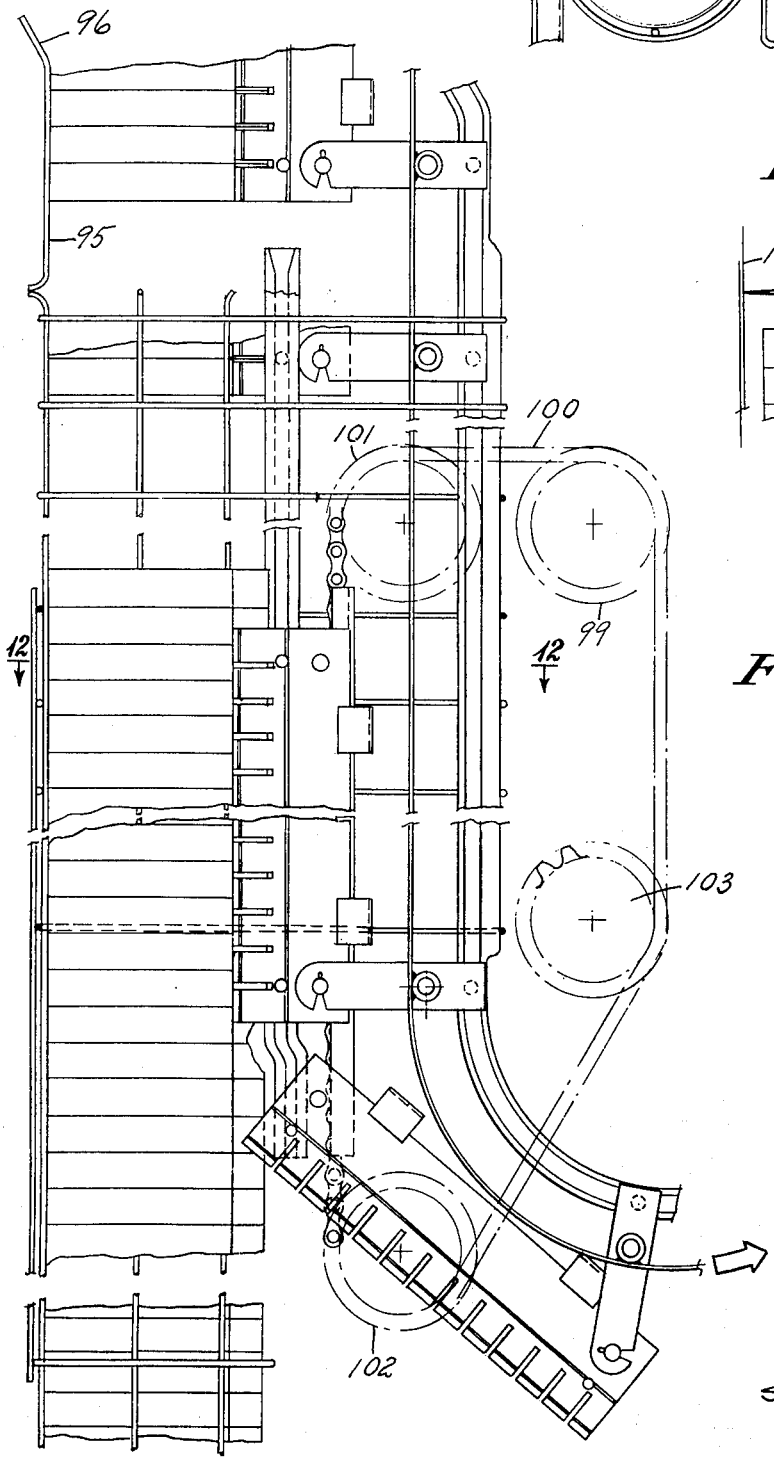
FIG. 11 is a fragmentary side elevational view showing means for feeding successive stacks of pile units prior to serial deposition upon a moving belt for advancement to points of attachment to a carpet web.
Figure 13:
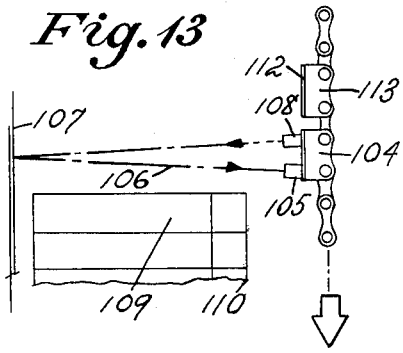
FIG. 13 is a side elevation view corresponding to the central right-hand portion of FIG. 11, and showing means for determining the location of the uppermost pile unit, thereby controlling the in-feeding of a group of stacked pile units in such manner as to avoid the possible upsetting of the same.
Figure 14:
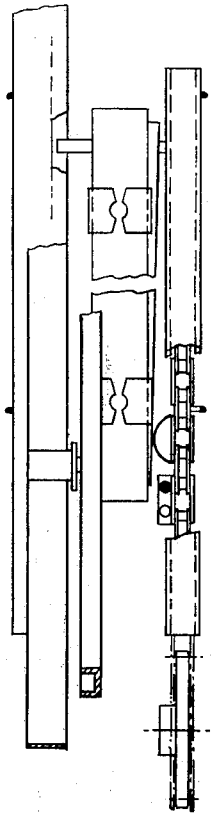
FIG. 14 is a fragmentary view in elevation as seen from the right-hand portion of FIG. 11.

The pile unit stacking and discharge means 14 is best understood from a consideration of FIGS. 3, 4, 5 and 11 to 14, inclusive. As seen in FIGS. 1 and 2, the means includes a plurality of cylindrical housings 92 communicating with corresponding rectangular housings 93. The cylindrical housings 92 may be provided with wire guides 95 to reduce friction, which as seen in FIG. 11 extend upwardly of the solid walls thereof, and may be flared as at 96. Clamp opening means 97 cannot be operated at random, but must be opened at a time when the lowermost unit in the newly transferred stack just overlies the uppermost unit in the remainder of the previous stack, thereby preventing canting or tilting of the individual units which would result in jamming of one or more units and preventing proper discharge from the lower ends of the cylindrical housings 92. As seen in FIGS. 11 and 12, this is accomplished by means of a servo motor 98 having a motion output sprocket 99 driving a link chain 100 over an upper idler sprocket 101, a lower idler sprocket 102, and a third idler sprocket 103. Referring to FIG. 13, an attachment bracket 104 mounts a light collimator 105, the beam 106 of which impinges upon a mirror 107, and reflects to a light detector 108. So long as light is detected, the servo motor is powered to move the bracket 104 downwardly until the presence of the uppermost unit 109 of the lower stack 110 interrupts the light beam, thereby halting operation of the motor 98. The carrier element 55 descending on the secondary transfer means then will contact the opening projection 112 on a subsequent link 113 (FIG. 12) thereby progressively releasing each of the units to fall upon the uppermost unit 109 without upsetting the newly added stack.

The above structure may be substituted by a feeler (not shown) which extends downwardly from the element 55–57 which mechanically senses the presence of the uppermost unit 109, and subsequently opens the clamps, or it is possible to have a computer count the units going into a given stack, and the withdrawal of the same from the lower end thereof so that a position of the uppermost unit may be calculated, and the clamps opened at the proper time.

Referring to FIGS. 3 to 7, inclusive, each of the cylindrical housings 92 is provided at the lower end 115 thereof with a compression gate 116 operated by a link 117, a bell crank 118 and an operating rod 119 by a programming means (not shown).

Figure 3:
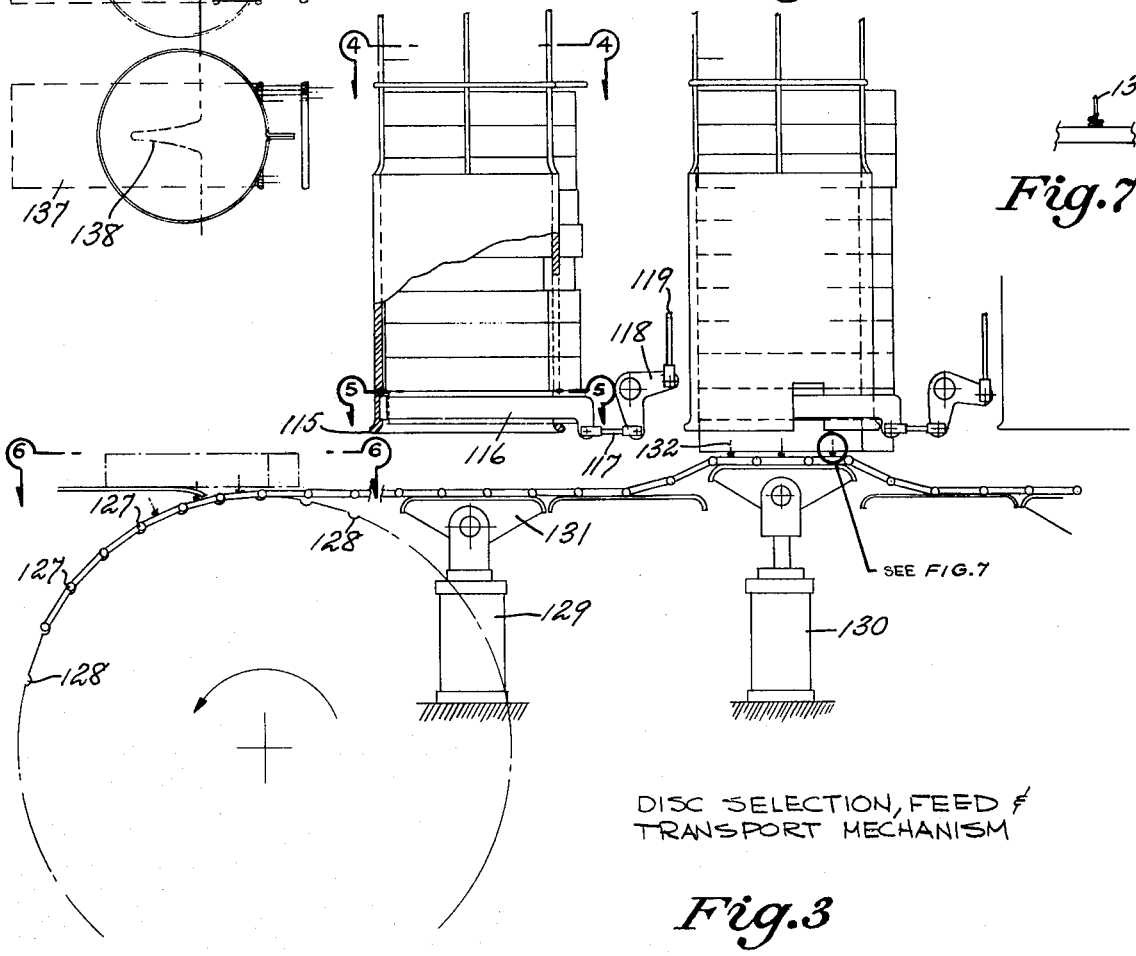
FIG. 3 is a fragmentary side elevational view of a pile unit selection, feed and transport mechanism.

The longitudinal transfer means 15 includes a plurality of individually controlled belts, some of which are indicated by reference character 120, and which move leftwardly as seen in FIGS. 1 and 2 to pass about a forward roller 121 and subsequently about a rear roller (not shown). Each belt is bounded by an upper surface 123, a lower surface 124, and side surfaces 125 and 126 spaced apart from each other a distance corresponding to the effective diameter of the individual units 47. Projecting pins 127 engage corresponding notches 128 in the forward roller 121 to assure positive driving. Each of the belts 120 passes over a plurality of actuators, two of which are indicated in FIG. 3 by reference characters 129 and 130. The actuators selectively raise followers 131 into contact with the gates 116 such that a pair of longitudinally aligned pins 132 (see FIGS. 2 and 7) enter the compressed fibers and maintain orientation of individual units 47 after the same pass through the gate 116.

Figure 18:
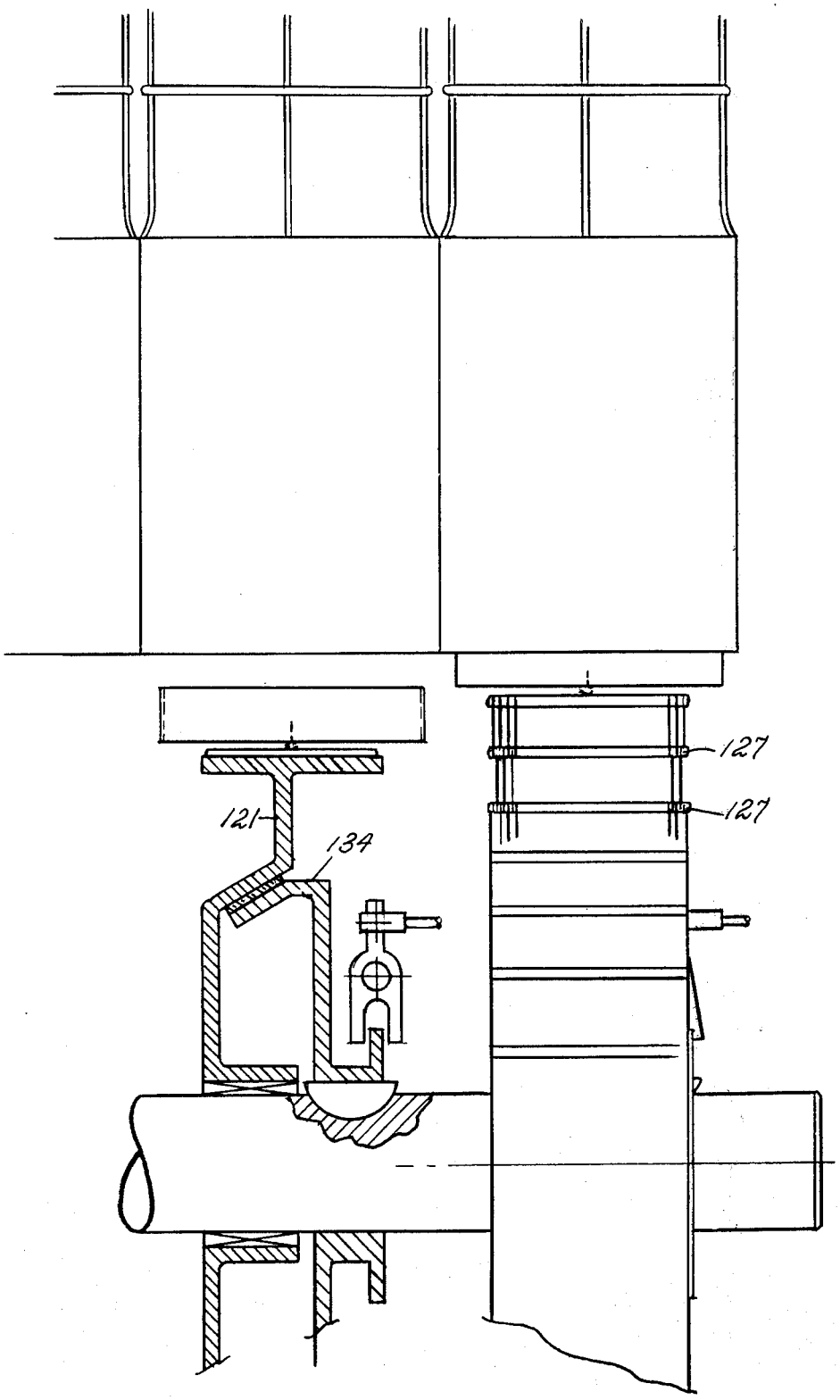
FIG. 18 is a fragmentary sectional view as seen from the plane 18—18 in FIG. 1 showing clutching means for controlling the parallel segments of a transport belt individually, to permit the formation of patterns in the completed pile article.

By means of individual clutch means 134 (see FIG. 18), each of the forward rollers 121 may be selectively arrested simultaneously with the elevation of a follower 131 to enable a desired unit 47 to be engaged. Following such engagement, the follower 131 is lowered, and rotation of the forward roller 121 is resumed. As seen in FIG. 3, it will be noted that each individual belt 120 may receive units 47 from any of several gates, each gate providing a different color of fiber, or a unit having a different design formed by fibers of different colors, thereby permitting the creation of a pattern in the finished article. To maintain uniformity, obviously, each belt must acquire as it travels a predetermined distance, the same number of units 47 as all of the other belts travelling the same distance, but the disposition of units upon the belts need not occur at the same longitudinal location, or even at the same instant. As the manufacture of the finished article progresses, all of the units 47 are moved leftwardly as seen in FIG. 3 and ultimately arrive more or less simultaneously at a transversely extending location immediately above the forward rollers 121 of each of the belts 120.

The pile assembly means 16 serves to position serially arriving units 47, following which the peripheral sleeve segments surrounding the same are severed and removed, and the compressed fibers allowed to expand and merge with the fibers of other units 47 in the same transverse rank. Reference is made to the left-hand portion of FIG. 1 and to FIG. 8. Horizontal guides 137 are provided with notches 138 for clearance of the pins 132 as the same are withdrawn from the units 47 and the units moved on to the upper surface of the guides. The guides 137 communicate with a supporting floor 139 and a plurality of parallel vertical walls 140, each having a leading end 141 and a trailing end 142. Oriented fiber is contained on the supporting floor 139 by side belts, one of which is indicated by reference character 143, each of which passes over an end roller 144 and a series of idler rollers 145. As the units 47 move leftwardly they are engaged by a tab-engaging wall 146 having notches 147 and opposed jaws 148 which engage the tab 60 of a unit 47 and hold the same until the segments 48 of the sleeves have been removed. The wall 146 is supported at one end by a shaft 149 coupled with motion-imparting means (not shown) which permits the wall to execute the rectangular path of motion 150 shown in FIG. 1. After the severed sleeve segments have been removed, the previously contained fibers are controlled in movement by four walls, 151, 152, 153 and 154, more conveniently referred to in FIGS. 8 and 9 as numbers 1, 2, 3 and 4. As seen in FIG. 1, each of the walls 151–154 has a corresponding path of motion 155, 156, 157 and 158, and reference is made at this point to FIGS. 8 and 9 which schematically illustrate the movements of each of the walls with the introduction of a row of units 47.

Referring to position 1 in FIG. 8, as the wall 146 advances a unit 47, walls 1 and 3 are elevated above the level of the working goods, wall 4 is below this level, and wall 2 is on this level. A leaf spring 160 (see position 1) bears against the unit 47 to stabilize it against the jaws 148 and then advances it leftwardly into a piercing device 161.

In the next position, wall No. 1 descends between wall 146 and unit 47. Then wall 146 and wall No. 1 move forward to pierce the sleeve segment 48 and rupture the same as it contacts the piercing member 161, on wall No. 2, following which it retracts and removes the no longer needed segment 48. Wall 146 is now withdrawn, and a cover 169 moves downwardly to overlie the now contained fibers. In position 3, walls No. 1 and No. 3 continue their downward movement, wall No. 3 occupying the position previously occupied by wall No. 1.

The cover 169 now lies coplanar with a larger plate 170. In position 4, the entire working goods, cover and plate advance one row to the left with walls 2 and 3. In position 5, wall 2 moves upwardly through a slot 163, permitting all of the fibers to merge. Wall No. 1 has reached its uppermost initial position, and awaits the return of wall 3 which has already moved partially upwardly along with wall 4. In position 6, the cover 169 has also moved upwardly and cover 170 has moved rearwardly one row. In position 7 (FIG. 9), wall No. 3 continues its upward movement prior to commencing its rightward movement wherein it overlies wall 1, thereby returning to the starting condition shown in position 1. Wall No. 2 has moved rightwardly to overlie wall No. 4, and subsequently, as seen in position 8, walls No. 2 and No. 4, and subsequently, as seen in position 8, walls No. 2 and No. 4 move downwardly to finally attain the relative position of FIG. 1. The wall 146 is now raised, permitting introduction of the next row of units 47 and subsequent repetition of the entire above-described cycle.

The web laminating means 17 advances a web 173 to an adhesive applicator 174 whereby one surface is coated with a suitable adhesive prior to adherence upon the free ends of the fibers. The web 173 passes between a roller 175 and a doctor blade 176 to spread the adhesive uniformly, following which the web passes over a roller 177 which positions it for engagement on the surface 172 formed by the upstanding ends of the now-merged fibers. Although the units 47 are advanced incrementally, with the cutting of the surrounding sleeve segments, with the expansion of the compressed fibers, the supply of fibers for adherence to the web 173 is substantially constant, so that the advance of the web 173 may be substantially continuous.

The web 178 is maintained in contact with the fiber ends for a period sufficient to permit proper adhesion, and it will be understood that the supporting floor 139 extends leftwardly for a distance sufficient to achieve this result. The completed article may be subjected to any operations conventional in the rug-making art, such as shearing and other finishing techniques.

Figure 19:
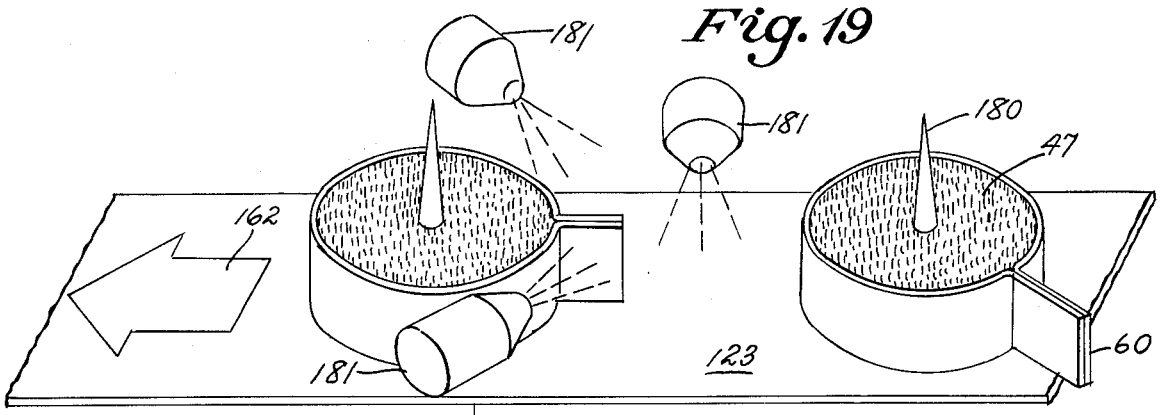
FIG. 19 is a schematic view showing pneumatic pile unit orienting means.
Figure 6:
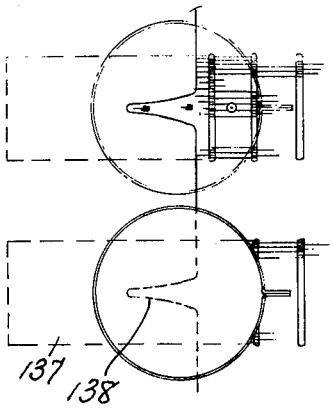
FIG. 6 is a fragmentary top plan view as seen from the plane 6—6 in FIG. 3.
Figure 4:
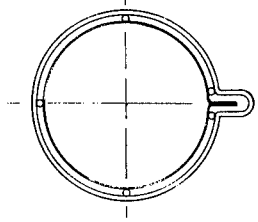
FIG. 4 is a horizontal sectional view as seen from the plane 4—4 in FIG. 3.
Figure 5:
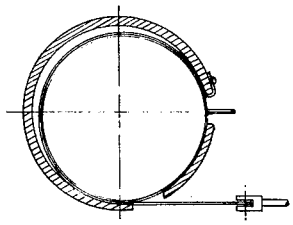
FIG. 5 is a horizontal sectional view as seen from the plane 5—5 in FIG. 3.
Figure 7:
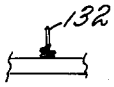
FIG. 7 is a fragmentary side elevational view showing a resilient pin in detail employed for engaging successive pile units during operation of the device.

FIG. 19 illustrates an optional means for orienting units 47 upon a belt surface 123, in which a single pin 180 penetrates a unit to permit rotation of the unit thereabout, through air jet means 181 which play on both surfaces of the tab 60, so that the unit reaches equilibrium when the tab is aligned with the principal axis of movement 162.

As will now be understood, the elements 25, 27, 32, etc. (FIG. 1) constitute a means for forming a radally symmetrical (i.e. cylindrical) bundle of axially aligned and more or less elongated fibers and for laterally compressing the fibers of the bundle while laterally enclosing the bundle in a sheath, thereby to form an elongated bundle of axially aligned fibers maintained in a condition of lateral compression by the sheath, as desired to facilitate longitudinal advance thereof without disruption of the fibers.

Cutting unit 34 constitutes a means for slicing the elongated sheathed bundle transversely into short cylindrical pile units. Specifically, blades 39 are thin, sharp, knife-like blades, and are moved by rotation in a direction transverse to the direction in which the blades advance into the bundle, so that a slicing action occurs which permits ready and uniform cutting of the bundle regardless of the thickness of the bundle. Each individual pile unit thus produced is a radially symmetrical (cylindrical) array of substantially axially aligned fibers (oriented with their cut or free ends at the ends of the unit) maintained in a laterally compressed condition by the surrounding sleeve segment which is cut with the fibers by blades 39.

The transfer means 12, 13, 14 and 15 (FIGS. 1 and 2) together constitute a means for disposing successive groups of pile units from the forming means (i.e. from the elements 25, 27, 32, etc., and cutting unit 34) in side-by-side relation on a supporting surface of the pile assembly means 16. As will be apparent from FIG. 1, the fibers of the deposited pile units are moved on the supporting surface in a direction toward the means 17 for applying a backing, such direction being defined herein as longitudinal of the supporting surface. The disposing means distributes the pile units of each group on the surface transversely of this longitudinal direction, so that the units of the group are disposed side by side across the width of the ultimately produced pile article.

Also included are means comprising serrated blades 161 and jaws 148 for releasing the fibers of each pile unit from lateral compression (by removing the surrounding sheath or sleeve therefrom) upon deposit of the unit on the supporting surface. Thereafter, the system of movable walls 151 – 154 advances the released pile units longitudinally of the surface.

It will be seen, especially from FIGS. 1, 8 and 10, that the transverse movable walls together with the longitudinal partitions 140 together define square areas each dimensioned to circumscribe the initially circular periphery of a pile unit, i.e. during the described forward advance of the unit on the supporting surface. That is to say, the square area within which each pile unit is thus enclosed is larger than the initial area of the laterally compressed unit. As the fibers of the unit are released from compression (by removal of the sleeve), they tend to "bloom" laterally to fill the entire square area enclosed by the movable walls and the partitions. At the same time, the walls are moving the released fibers laterally (toward the backing-applying means 17) across the stationary surface. This motion exerts a force on the fibers which promotes their expansion (within the limits of the aforementioned square area) as they move, with the result that they rapidly and uniformly expand to fill the entire square area, as will be apparent from the showing of the fibers abutting wall 152 in FIG. 1.

In other words, while the movable walls to some extent confine the fibers, they also permit and indeed apply a force to promote expansion of the released fibers within the area bounded by the walls. Because of the applied force, such expansion occurs more rapidly and uniformly than would be the case if the pile units were left to bloom without applied force after release. As the released pile units are advanced beyond the last of the movable walls, they merge with other released pile units to form a continuous pile fiber assembly of substantially uniform density, undergoing at least minor further expansion (again aided by force exerted by the movable walls) to fill gaps between adjacent units.

The embodiment of the invention thus far described is illustrative of one arrangement for applying a force to promote expansion of released pile units. Other arrangements are shown in FIGS. 20 – 23.

Figure 20:
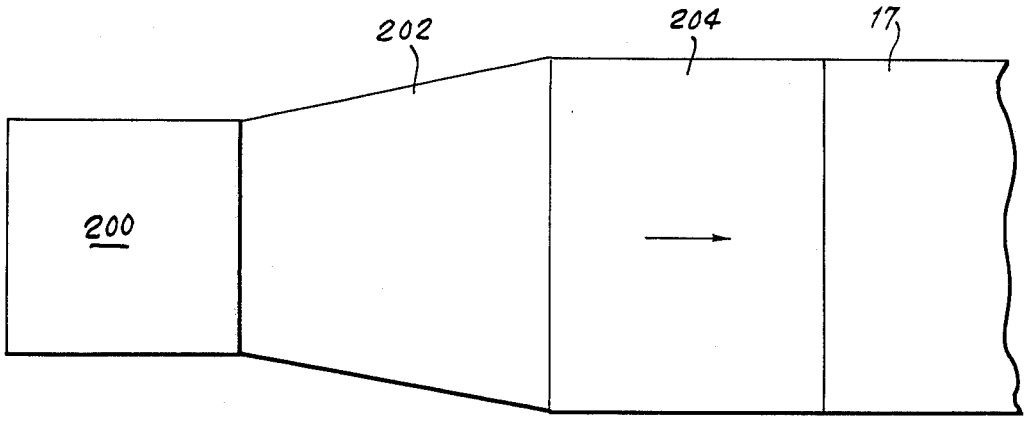
FIG. 20 is a schematic plan view of another embodiment of the invention.
Figure 21:
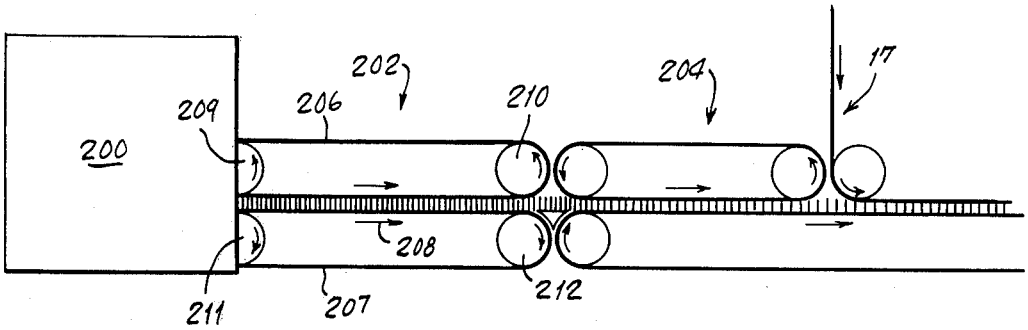
FIG. 21 is a schematic side elevational view of the embodiment of FIG. 20.
Figure 22:
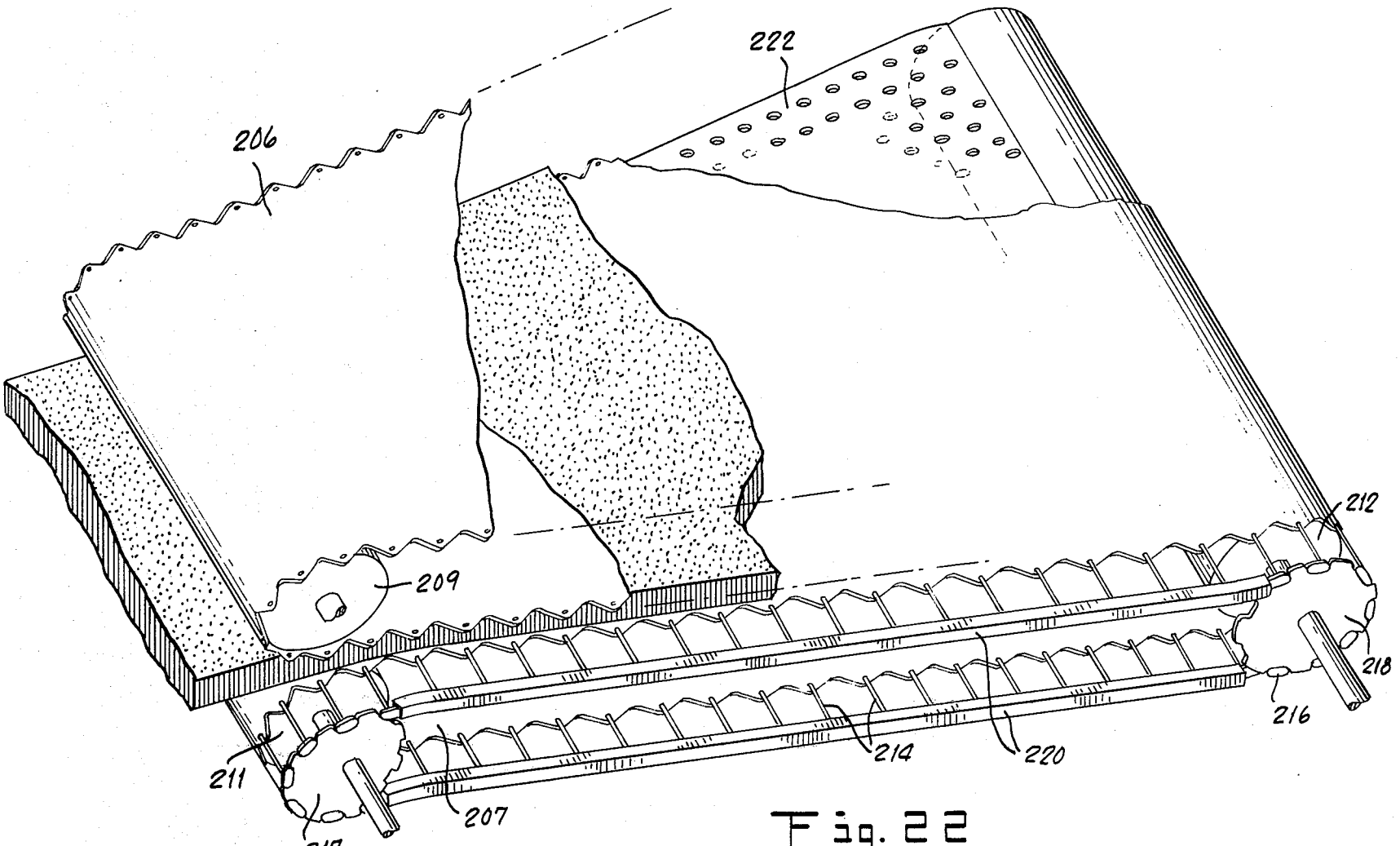
FIG. 22 is a fragmentary perspective view of the expandable belt mechanism of the embodiment of FIGS. 20–21.

Referring to FIGS. 20 – 22, the apparatus elements represented diagrammatically by block 200 may correspond to those portions of the apparatus of FIGS. 1 and 2 ahead of the backing-applying means 17, and may thus include the pile unit forming means 25, 32; the pile unit depositing means 13, 14, 15 and 16; and the means for releasing pile units from lateral compression and advancing the same while applying a force thereto to promote expansion of the released units, i.e. movable walls 151–154 and associated instrumentalities. Apparatus portion 200, in other words, at its outlet end discharges a continuous assembly of pile fibers similar to that which is advanced to the backing-applying means in the apparatus of FIGS. 1 and 2.

In the embodiment of FIGS. 20 – 22, means 202 and 204 for expanding the pile fiber assembly are interposed between the elements collectively designated 200 and the means 17 for applying a backing. The first expanding means 202 comprises a pair of laterally stretchable or elastic endless belts 206, 207 having adjacent parallel surfaces between which the pile fiber assembly is advanced. These surfaces respectively engage the upper and lower ends of the fibers of the assembly, and as the belts are driven by suitable means (not shown), the fibers are advanced by the belts in the direction indicated by the arrow 208.

As best seen in FIGS. 21–22, the upper belt 206 is trained around rollers 209, 210, while the lower belt 207 is trained around lower rollers 211, 212. Referring more particularly to the lower belt, it will be seen that this belt is attached at a plurality of locations along each edge, as by wires 214, to an endless chain 216 trained around sprockets 217, 218 respectively mounted coaxially with the rollers 211 and 212 for rotation therewith. The axial dimension of roller 212 is substantially greater than that of roller 211, and sprockets 218 are correspondingly spaced substantially farther apart (along the axis of roller 212) than are sprockets 217 (along the axis of roller 211). Intermediate the sprockets, chain 216 may pass through guide channels 220. A plate 222 may be mounted beneath the upper run of the lower belt 207 to aid in supporting that belt between the rollers. The upper belt 206 is similarly connected to a chain and sprocket system (not shown).

Owing to the aforementioned difference in relative spacing between the sprockets 217 and the sprockets 218 (and the corresponding sprockets associated with the upper belt), the fiber-engaging runs of the belts are progressively stretched or expanded transversely of the direction of fiber feed as they advance, with the fiber assembly between them, from elements 200 toward the backing-applying means 17. Preferably, the belt surfaces are such that there is substantial friction between them and the fiber ends they engage. Consequently, the progressive expansion of the belts exerts forces on the fibers of the assembly so as to spread or expand the fiber assembly laterally in a direction transverse to the direction of advance thereof.

As will be understood, the belts are stretched by virtue of their edgewise connection to the aforementioned chains, and the return runs of the belts progressively contract as they are advanced in a direction opposite to the direction of fiber feed.

In other words, the effect of the transversely expanding belts is to produce corresponding transverse expansion of the fibers of the pile assembly i.e. by virtue of the frictionally exerted forces applied thereto. Thus the fiber assembly at the downstream end of means 202 is substantially wider than the assembly as discharged from elements 200.

Means 204, to which the fiber assembly is advanced from means 202, comprises upper and lower endless belts which are driven at a rate faster than the drive speed of belts 206 and 207, and which are positioned to receive and engage the fiber assembly for continued advance thereof to the backing-applying means 17. Owing to the relatively enhanced rate of speed of the belts of means 204, the fiber assembly is expanded longitudinally, i.e. in the direction of advance of the assembly.

The backing-applying means 17 functions in the same manner as in the apparatus of FIGS. 1 – 2, i.e. to adherently apply a suitable backing to the upper free ends of the fibers of the expanded assembly.

Figure 23:
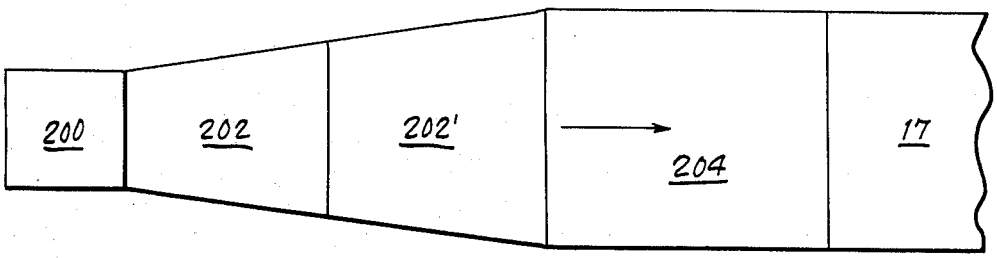
FIG. 23 is a schematic plan view of a further modified embodiment of the invention.

Use of the means 202 and/or 204 permits desired control of pile density in the ultimately produced pile article. If more expansion of the fiber assembly is desired than can be accommodated by a single pair of transversely expanding belts, one or more further sets 202' of such belts may be interposed between the first set 202 and the means or belts 204 for expanding the fiber assembly longitudinally, as shown in FIG. 23.

A further advantage of the transverse expansion feature of the embodiments of FIGS. 20 – 23 is that it facilitates provision of a pile article substantially wider than the width of the initial fiber assembly produced by the pile-unit-forming and pile-assembling means 200. This enables attainment of desired economy of space and size in the provision of the elements 200 and also permits a unit 200 of standard dimensions to be used in production of pile articles of different widths i.e. depending on the extent of transverse expansion provided by the downstream expanding means with which it is associated.

In some cases, the transverse expanding means 202 or the longitudinal expanding means 204 may be used alone if expansion of the pile fiber assembly in only one direction is desired. Also, the specific belt structures described above are merely exemplary of these means; for instance, the longitudinal expanding means 204 could comprise longitudinal stretchable belts which are progressively expanded in a longitudinal direction rather than belts (as shown) of fixed dimensions travelling at a faster rate of speed than belts 202.

Indeed, if it is desired to produce a pile article narrower than the pile assembly produced by elements 200, the orientation of the transverse expanding means 202 may be reversed, e.g. with spreading of the fibers (for density control) accomplished by longitudinal expanding means 204.

It is to be understood that the invention is not limited to the features and embodiments hereinabove specifically set forth but may be carried out in other ways without departure from its spirit.

I claim:

1. In apparatus for producing a nonwoven pile article, in combination, a. means for forming separate pile units each comprising a substantially radially symmetrical array of free-ended fibers substantially axially oriented such that ends of the fibers are at the ends of the pile units, and laterally compressed together and separable in maintained relative axial orientation upon release from lateral compression;

b. means for supporting plural pile units in side-by-side relation;

c. means for successively disposing a plurality of groups of the separate pile units from the forming means in side-by-side relation on said supporting means while maintaining the fibers of each unit laterally compressed together with the fibers of each unit separate from and unconnected to the fibers of each adjacent unit, each group comprising plural units distributed transversely of the supporting means, said disposing means including means for releasing the fibers of each pile unit from lateral compression upon disposition thereof on said supporting means;

d. means for laterally advancing the released pile units longitudinally of the supporting means while permitting expansion thereof and while applying a force to the released pile units on said supporting means for promoting expansion thereof, by separation of the fibers thereof in maintained relative axial orientation, into contact with adjacent pile units, to produce a continuous, substantially uniform assembly of pile fibers; and e. means for applying an adherent backing to at least one end of the fibers of the expanded pile units to form a pile article wherein the expanded pile units constitute the pile.

2. Apparatus as defined in claim 1, wherein said unit-forming means further includes means for forming an elongated, substantially radially symmetrical bundle of fibers extending longitudinally of the bundle and laterally compressing said bundle while wrapping and securing a removable sheath around said bundle to hold the fibers thereof laterally compressed together, and means for slicing said bundle transversely into pile units.

3. Apparatus as defined in claim 2, wherein said bundle-forming means produces a substantially cylindrical sheathed bundle such that the produced pile units are substantially cylindrical.

4. Apparatus as defined in claim 2, wherein said disposing means includes means for simultaneously delivering a group of the pile units to said supporting means along parallel paths, and wherein said unit-forming means includes means for distributing plural pile units to each of plural locations respectively associated with said paths for reception and advance of the units by said disposing means.

5. Apparatus as defined in claim 2, wherein said slicing means slices a portion of said sheath with each said pile unit, the sliced sheath portion constituting a sleeve surrounding and laterally compressing the fibers of the sliced pile unit; and wherein said fiber-releasing means comprises means for removing the sleeve from each pile unit.

6. Apparatus according to claim 1, wherein said disposing means disposes said pile units on said supporting means in adjacent relation but initially spaced apart by a distance smaller than the minimum lateral dimension of an individual pile unit, and wherein said releasing means releases the fibers of each pile unit as aforesaid prior to contact of the unit with adjacent pile units.

7. Apparatus as defined in claim 1, wherein said advancing means includes a transversely expandable endless belt, means for driving said belt longitudinally, and means for progressively transversely stretching a first run of said belt as said first run advances in a given direction, said first run being disposed to engage free ends of fibers of released pile units for advancing the same in said given direction while spreading the fibers transversely of said given direction.

8. Apparatus as defined in claim 7, wherein said advancing means further includes means for advancing fibers of released pile units in said given direction while spreading the fibers in said given direction.

9. In apparatus for producing a nonwoven pile article, in combination, a. means for forming separate pile units each comprising an array of free-ended fibers substantially axially oriented such that ends of the fibers are at the ends of the pile units, and laterally compressed together and separable in maintained relative axial orientation upon release from lateral compression, said forming means including means for forming an elongated, substantially radially symmetrical bundle of fibers extending longitudinally of the bundle and laterally compressing said bundle while wrapping and securing a removable sheath around said bundle to hold the fibers thereof laterally compressed together, and means for slicing said bundle transversely into pile units each substantially radially symmetrical about an axis extending from end to end thereof;

b. means for supporting plural pile units in side-by-side relation, including means for laterally advancing the supported pile units in a predetermined direction;

c. means for disposing successive groups of the separate pile units from the forming means in side-by-side relation on said supporting means with the pile units of each said group distributed transversely of said predetermined direction while maintaining the fibers of each unit laterally compressed together during disposition thereof with the fibers of each unit separate from and unconnected to the fibers of each adjacent unit, said disposing means including means for releasing the fibers of each pile unit from lateral compression upon disposition thereof on said supporting means, said advancing means advancing said pile units after release thereof; and d. means for applying an adherent backing to at least one end of the fibers of the released pile units to form a pile article wherein the released pile units constitute the pile.

10. Apparatus as defined in claim 9, wherein said advancing means includes means for laterally spreading the fibers of the released pile units in a direction transverse to said predetermined direction during advance thereof.

11. A device for forming articles having a nonwoven pile on at least one surface thereof comprising: means for forming a plurality of basic pile units, each of generally planar cylindrical configuration, each including compressed oriented fibers surrounded by a removable sleeve, and each having a radially projecting tab; a plurality of horizontally oriented endless in-feed belts arranged in mutually spaced and parallel disposition, a fixed substantially horizontal surface adjacent a continuous segment of each of said belts; means for transferring pile units from said forming means to overlie each of said belts in stacked relation for serial disposition upon said belts to be advanced to said horizontal surface; pile assembly means including means for transferring said pile units from said belts to said horizontal surface, and means for rupturing and removing said sleeves of said units and allowing the oriented fibers to expand and merge with the fibers of adjacent pile units; means supplying a web of adhesively coated backing material to a location overlying said horizontal surface to contact one end of said oriented fibers to be supported by said surface and adhere thereto; primary endless conveyor means extending across the path of each of said endless in-feed belts, a plurality of carrier elements carried by said primary conveyor means engaging the radially projecting tabs of a stack of pile units at the location of said forming means, and transferring the same to overlie a predetermined endless in-feed belt, at least one stack receiving means overlying each belt, said stack receiving means having gating means at a lower end thereof; and secondary conveyor means disconnecting said carrier elements from said primary conveyor means and transferring the same along a substantially vertical axis of movement to position an engaged stack of pile units to engage said predetermined endless in-feed belt.

12. Structure in accordance with claim 11, including means associated with said stack receiving means to disengage an engaged stack of pile units from said carrier element in a manner that prevents tumbling of said pile units.

13. Apparatus for producing a nonwoven pile article, comprising a. means for forming an assembly of substantially axially aligned pile fibers having opposed free ends, the fibers of said assembly being laterally movable relative to each other;

b. belt means for engaging free ends of the fibers of said assembly and advancing the fibers in a given direction while spreading the fibers laterally apart in a direction transverse to said given direction; and c. means for adherently applying a backing to free ends of the fibers of the assembly after spreading of the fibers, to form a pile article wherein the assembly constitutes the pile;

d. said belt means comprising a transversely expandable endless belt, means for driving said belt longitudinally, and means for progressively transversely stretching a first run of said belts as said first run advances in said given direction.

14. A method of making a nonwoven pile article comprising a. forming a plurality of separate pile units each comprising an array of free-ended fibers substantially axially oriented such that ends of the fibers are at the ends of the pile units, and laterally compressed together and separable in maintained relative axial orientation upon release from lateral compression, each of said units being substantially radially symmetrical about an axis extending from end to end thereof;

b. disposing and supporting a group of the separate pile units in side-by-side relation while maintaining the fibers of each unit laterally compressed together with the fibers of each unit separate from and unconnected to the fibers of each adjacent unit;

c. releasing the fibers of each pile unit from lateral compression upon disposition thereof in side-by-side relation with other pile units as aforesaid;

d. laterally advancing the released pile units while permitting expansion thereof and while applying a force to the released pile units for promoting expansion thereof, by separation of the fibers thereof in maintained relative axial orientation, into contact with adjacent pile units to form a continuous substantially uniform pile fiber assembly; and e. applying an adherent backing to at least one end of the fibers of the expanded pile units to form a pile article wherein the expanded pile units constitute the pile.

15. A method according to claim 14, wherein the step of forming the pile units includes forming an elongated and substantially radially symmetrical bundle of fibers extending longitudinally of the bundle and laterally compressing the bundle while wrapping and securing a removable sheath around it to hold the fibers thereof laterally compressed together, and slicing the bundle transversely into pile units.

16. A method according to claim 15, wherein the step of disposing a group of pile units includes distributing the group of pile units in a first direction, and wherein the advancing step comprises advancing the fibers of the released pile units laterally in a second direction transverse to said first direction.

17. A method according to claim 16, wherein the step of disposing a group of pile units includes successively depositing a plurality of groups of pile units in side-by-side relation distributed in said second direction; and wherein the advancing step includes laterally advancing the fibers of the released pile units of each successive group, the application of force as aforesaid promoting expansion of the released pile units of each group into contact with each other and with adjacent pile units of other adjacent groups on the surface.

18. A method according to claim 17, wherein the releasing step includes removing the sheath from surrounding engagement with the fibers of each pile unit prior to applying a force for expanding the pile unit.

19. A method according to claim 14, wherein the advancing step includes laterally advancing the fibers of the released pile units in a given direction while laterally spreading the fibers of the released pile units in a direction transverse to said given direction.

20. A method according to claim 19, wherein the advancing step further includes laterally advancing the fibers of the released pile units in said given direction while laterally spreading the fibers of the released pile units in said given direction.

21. A method of making a nonwoven pile article comprising a. forming a plurality of separate pile units each comprising an array of free-ended fibers substantially axially oriented such that ends of the fibers are at the ends of the pile units, and laterally compressed together and separable in maintained relative axial orientation upon release from lateral compression, each of said units being substantially radially symmetrical about an axis extending from end to end thereof;

b. depositing and supporting successive groups of the separate pile units in side-by-side relation with the pile units of each group distributed in a first direction and the successive groups distributed in a second direction transverse to said first direction while maintaining the fibers of each unit laterally compressed together until deposit thereof with the fibers of each unit separate from and unconnected to the fibers of each adjacent unit;

c. releasing the fibers of each pile unit from lateral compression upon deposit thereof in side-by-side relation with other pile units as aforesaid;

d. laterally advancing the released fibers in a direction transverse to said first direction; and e. applying an adherent backing to at least one end of the fibers of the released pile units to form a pile article wherein the released pile units constitute the pile.

22. Apparatus for producing a nonwoven pile article, comprising a. means for forming an assembly of substantially axially aligned pile fibers having opposed free ends, the fibers of said assembly being laterally movable relative to each other;

b. means for advancing said assembly in a given direction while applying to the fibers of the assembly a force for spreading the fibers of the assembly laterally apart at least in a direction transverse to said given direction, said force-applying means comprising means for effecting substantially uniform transverse displacement of adjacent fibers relative to each other across the full width of the assembly; and c. means for applying an adherent backing to free ends of the fibers of the assembly after spreading of the fibers, to form a pile article wherein the assembly constitutes the pile.

23. A method of making a nonwoven pile article, comprising the steps of a. forming an assembly of substantially axially aligned pile fibers which are movable laterally relative to each other in the assembly, said fibers having opposed free ends;

b. laterally advancing the assembly in a first direction while c. laterally spreading the fibers thereof at least in a second direction transverse to said first direction by applying a force to the fibers for effecting substantially uniform transverse displacement of adjacent fibers relative to each other across the full width of the assembly; and d. applying an adherent backing to free ends of the fibers of the assembly after spreading thereof as aforesaid.

* * * * *